US006619075B2

(12) United States Patent
Morita

(10) Patent No.: US 6,619,075 B2
(45) Date of Patent: Sep. 16, 2003

(54) FLAT BED KNITTING MACHINE HAVING AN OIL FEEDING DEVICE

(75) Inventor: Toshiaki Morita, Wakayama (JP)

(73) Assignee: Shima Seiki Manufacturing, Ltd., Wakayama (JP)

( * ) Notice: Subject to any disclaimer, the term of this patent is extended or adjusted under 35 U.S.C. 154(b) by 0 days.

(21) Appl. No.: 10/257,985

(22) PCT Filed: May 14, 2001

(86) PCT No.: PCT/JP01/03997

§ 371 (c)(1),
(2), (4) Date: Oct. 30, 2002

(87) PCT Pub. No.: WO01/88244

PCT Pub. Date: Nov. 22, 2001

(65) Prior Publication Data

US 2003/0140660 A1 Jul. 31, 2003

(30) Foreign Application Priority Data

May 17, 2000 (JP) ..... 2000-144971

(51) Int. Cl.[7] ..... D04B 7/04
(52) U.S. Cl. ..... 66/64
(58) Field of Search ..... 66/60 R, 64, 8, 66/168; 184/6, 6.4, 7.4, 6.14, 6.15, 6.1

(56) References Cited

U.S. PATENT DOCUMENTS 4,464,913 A * 8/1984 Rosenquist et al. ..... 66/166
4,509,618 A * 4/1985 Kuhn ..... 184/6.4
4,759,426 A * 7/1988 Brunner ..... 184/6.4
5,154,259 A * 10/1992 Magome ..... 184/74
6,003,343 A * 12/1999 Plath ..... 66/8

FOREIGN PATENT DOCUMENTS

JP 04-333649 11/1992
JP 2 259 718 A 3/1993
JP 06-108352 4/1994

* cited by examiner

*Primary Examiner*—Danny Worrell
(74) *Attorney, Agent, or Firm*—Rothwell, Figg, Ernst & Manbeck

(57) ABSTRACT

A flat bed knitting machine having an oil feeding device is disclosed. Lubricant oil is fed, just when needed, to knitting members, such as needles, jacks and sinkers. The numbers of operations of knitting members are counted, and when a counted number exceeds a predetermined value, lubricant oil will be sprayed from a jet-type nozzle to the relevant knitting member.

14 Claims, 8 Drawing Sheets

FIG. 6

| Needle Block No. | Fabric No. | Course No. |
|---|---|---|
| 1 | 2 | 150 |
| 2 | 1 | 1480 |
| 3 | 1 | 800 |
| 4 | 1 | 550 |
| 5 | 1 | 800 |
| ⋮ | ⋮ | ⋮ |
| n | 0 | 0 |

FLAT BED KNITTING MACHINE HAVING AN OIL FEEDING DEVICE

TECHNICAL FIELD

The present invention relates to a flat bed knitting machine having an oil feeding device that feeds oil to knitting members including needles, jacks and sinkers that are arranged in parallel with each other on the needle beds of the flat knitting machine.

BACKGROUND ART

The present applicant proposed a flat bed knitting machine having an oil feeding device that was disclosed in Japanese Patent Opening Hei 4-333649. The oil feeding device comprises a feed pump being provided on the machinery of the flat bed knitting machine, lubricant oil contact members such as brushes, being provided on the carriage that reciprocates and scans over needle beds, and flexible oil tubes (interconnecting pipe) connecting the pump and the contact members. In this flat knitting machine, as brushes for applying lubricant oil are provided to the carriage, oil feeding is made within a traveling range of the carriage or fabric knitting range. Accordingly, unlike the prior art, it is not necessary to shift the carriage to oil feeding brushes being fixed at one side end of the needle beds every specified travel to apply lubricant oil to cams being provided to the carriage even when not all the needles of the needle beds are used, for example, when a fabric having a small knitting width is to be knitted. Thus wasteful travel of the carriage and oil feeding to needles not requiring oil feeding can be prevented.

The operation, however, of charging the brushes with lubricant oil may be effected manually by an operator through pumping, or it may be done automatically every specified period when the oil feeding pump is a motor-driven pump. These arrangements pose the following problems. In the case of manual pumping, an operator may sometimes forget charging the brushes with lubricant oil which may cause seizure or friction between needles and cams engaging with each other. Moreover, if the timing of pumping is not appropriate, oil may be fed to needles not requiring oil feeding. In the case of motor-driven pumping, oil is fed every specified period, every specified number of knitted fabric, or at fixed intervals. This method is not desirable because, unlike the circular knitting machine, knitting is not effected circumferentially in a fixed direction in the flat bed knitting machine and the carriage reciprocates over the needle beds by reversing at appropriate points according to knitting data or knitting width. When two or more fabrics are simultaneously knitted by reciprocating the carriage over needles of different zones of the needle beds, such methods are commonly called two-fabric knitting, three-fabric knitting and multi-fabric knitting, oil feeding by means of contact members utilizing capillarity of brushes, felts, etc. results in repetition of useless oil feeding to needles that are located between respective fabrics being knitted and are not used for knitting.

DISCLOSURE OF THE INVENTION

One object of the present invention is to provide a flat bed knitting machine having an oil feeding device that feeds oil to the respective knitting members at appropriate time, namely, at effective points (including place and time) according to the degree of usage of each of the knitting members such as needles, jacks and sinkers in knitting a fabric or fabrics.

Another object of the present invention is to provide a flat bed knitting machine having an oil feeding device that can selectively feed oil to knitting members at specified points on the needle beds. The flat bed knitting machine having an oil feeding device according to the present invention has at least a pair of a front needle bed and a rear needle bed, wherein a plurality of knitting members such as needles and jacks are positioned parallel to each other on the needle beds such that they move forwards and backwards, and a carriage moving and scanning reciprocally on the needle beds and having cams for selecting and operating knitting members according to knitting data for knitting a knitted fabric and is characterized by:

an oil feeding device including a lubricant oil supplying means for supplying lubricant oil through interconnection pipes to oil feeders being provided to the carriage for feeding lubricant oil to said plurality of knitting members;

oil feeding data processing means for determining and outputting knitting members to be fed with lubricant oil as oil feeding data according to the knitting data or a locus of the carriage; and control means for controlling the oil feeding device according to the oil feeding data during knitting of the knitted fabric such that said knitting members to be fed are fed with lubricant oil.

Thus the oil feeding data processing means selects knitting members to be fed with oil from the knitting members such as needles and jacks being arranged on the needle beds according to the knitting data of a fabric or fabrics to be knitted or the locus of the carriage and expresses them as oil feeding data. The oil feeding data may be written in the knitting data in advance. Then, according to the oil feeding data, the control means operates the oil feeding device to feed oil to the knitting members to be fed with oil. In this way, as oil is fed to necessary knitting members, oil can be fed efficiently in contrast to a piece of prior art where oil is fed to all the knitting members. Moreover, as oil feeding is automatically made during knitting, the knitting efficiency will be improved and there will be no damage to knitting members due to missed oil feeding.

It is preferable that said control means controls the oil feeders. Controlling the oil feeders rather than controlling the oil pump, etc. of the lubricant oil supplying means, which has slow response, facilitates selective oil feeding to the knitting members to be fed with oil.

It is preferable that said oil feeding data processing means determines said knitting members to be fed with oil by evaluating numbers of operations of knitting members according to the knitting data. Knitting data easily shows which knitting member is used what times. The number of operations of the knitting member may be determined accurately for each individual knitting member, or may be approximated.

It is particularly preferable that said oil feeding data processing means determines said numbers of operations of knitting members before knitting of a knitted fabric according to the knitting data of said knitted fabric. In this way, before knitting, the knitting data may be read in advance to determine the numbers of operations of knitting members. This allows easier data processing in comparison with the case wherein the numbers of operations of knitting members are determined during knitting.

It is preferable that said oil feeding data processing means determines the locus of the carriage during knitting of a fabric and determines knitting members to be fed from the determined locus of the carriage. The locus of the carriage will show which knitting members are used what times. Hence knitting members within some locus can be estimated to have been used.

It is particularly preferable that said oil feeding data processing means determines said knitting members to be fed by counting numbers of operations of knitting members by the carriage. Here, when the carriage selects and operates a knitting member, this will be detected to count the number of operations. In this way, the number of operations of each knitting member can be determined from the movement of the carriage.

It is preferable that said plurality of knitting members are grouped into plural blocks, that said oil feeding data processing means determines said knitting members to be fed block by block, and that said oil feeders feed oil to knitting members block by block. As oil feeding is made block by block, oil feeders may be ones that can not selectively feed oil to the individual knitting members. Knitting members to be fed can be determined roughly block by block.

Such oil feeders comprise contact members that contact, for example, knitting members to supply lubricating oil, such as brush, felt, sponge, cloth or belt. Actuators are preferably provided to move the contact members between a position wherein the contact members contact knitting members and a position wherein the contact members do not contact knitting members, and the actuators are controlled by said control means. In this way, oil can be fed selectively to blocks to be fed.

It is preferable that said oil feeding data processing means determines said knitting members to be fed by counting numbers of operations of respective knitting members by the carriage and by comparing the numbers counted with a predetermined threshold value. In this way, knitting members to be fed can be determined accurately and oil can be fed selectively to them.

It is preferable that said oil feeders are provided with a jet-type nozzle for spraying lubricant oil.

It is particularly preferable that said jet-type nozzle sprays lubricant oil selectively to respective knitting members to be fed while the carriage travels.

It is most preferable that said jet-type nozzle sprays lubricant oil to respective knitting members to be fed in a synchronous manner that the carriage selects said respective knitting members. In this way, whenever the carriage selects a knitting member to be fed, said knitting member can be fed with oil in synchronization with its selection.

It is preferable that said oil feeding data processing means accumulates the numbers of operations of knitting members for a plurality of the knitted fabrics to be knitted according to the knitting data and determines knitting members to be fed It is preferable that said oil feeding data processing means determines knitting members to be fed from the locus of the carriage over a plurality of knitted fabrics.

In this way, oil can be fed reliably to knitting members that do not require oil feeding for knitting a single knitted fabric but require oil feeding for knitting a plurality of knitted fabrics.

BRIEF DESCRIPTION OF THE DRAWINGS

FIG. 6 shows stored oil feeding data when oil feeding is made block by block.

BEST MODE FOR CARRYING OUT THE INVENTION

Preferable embodiments of the oil feeding device of the flat bed knitting machine according to the present invention will be described in the following with reference to the drawings.

EMBODIMENT 1

In the oil feeding device of the present embodiment, a feed pump for supplying lubricant oil, which is provided on the fame of the machinery of the flat bed knitting machine, and oil feeders such as jet-type nozzles, which are mounted on the carriage reciprocating and scanning over needle beds, are interconnected with flexible oil tubes or the like. In this embodiment, the knitting data is read and analyzed in advance to determine the knitting members (knitting needles in this case) requiring oil feeding during knitting. The knitting data is necessary for knitting a fabric or fabrics and includes data of patterns, control, loop length, patterning, color yarns, take down, etc., and can be developed by using a knit design system (hereinafter referred to as CAD") or by manually inputting data direct to the control device of the knitting machine. The knitting data that is developed by CAD is read by the control device of the knitting machine and analyzed, before actual knitting, to determine the number of operations, or number of selection, of each knitting needle while one fabric is knitted. During the actual knitting, oil is fed to a knitting needle of which number of operations exceeds a prescribed value.

Figure 1:
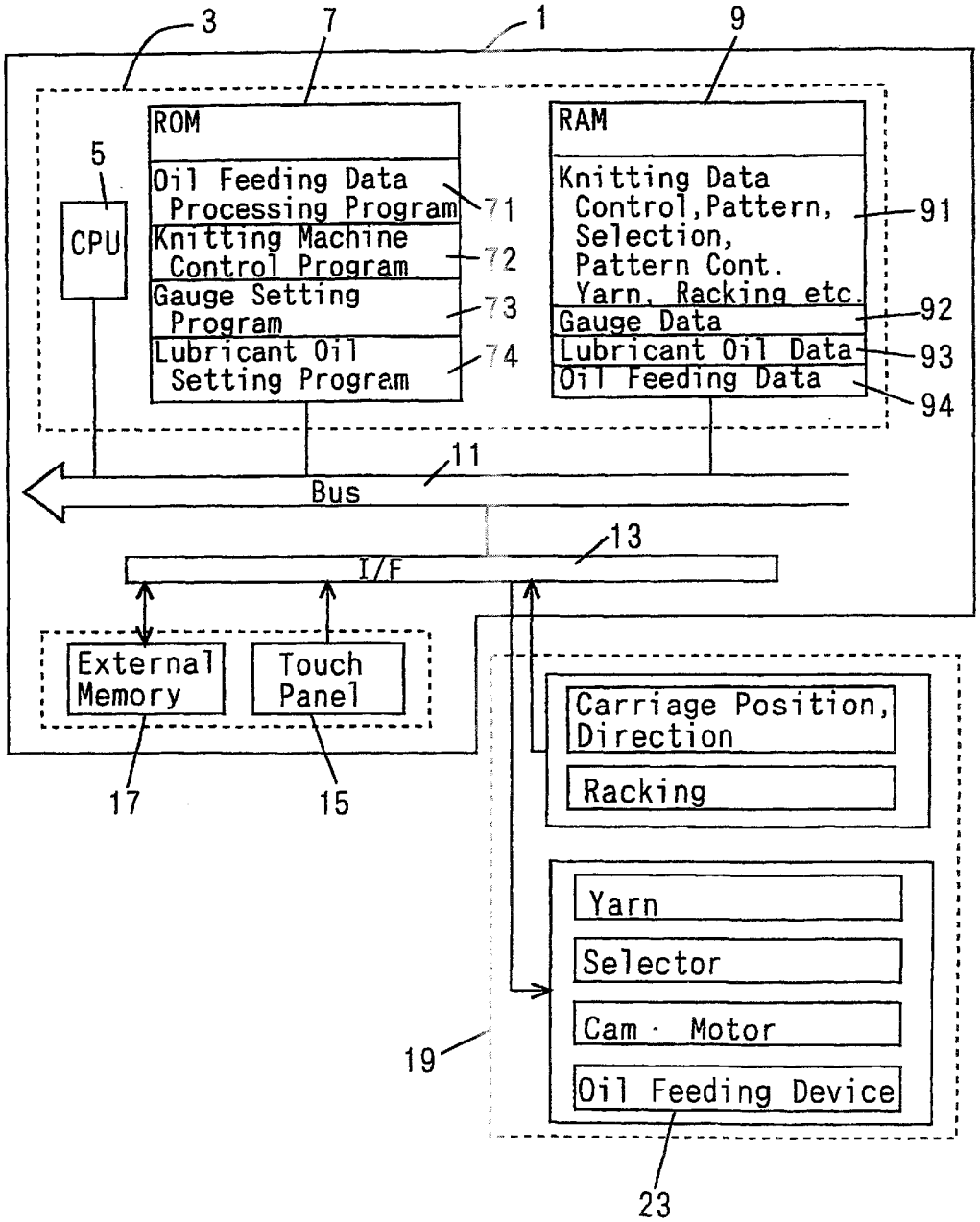
FIG. 1 is a block diagram showing the oil feeding device of the embodiment of the present invention.

FIG. 1 is a block diagram of the present embodiment including the oil feeding device and is provided with a main controller 3. The main controller 3 has a CPU 5, a ROM 7 storing the operation programs of the CPU 5, etc. and a RAM 9, a working memory, that can be read and written. The main controller 3 and an input /output interface (I/F) 13 is connected to a bus 11. A touch panel 15, which is used by an operator for inputting various data by using command keys displayed on the panel, an external memory 17 such as floppy discs, hard discs or magnet optical discs, etc., and the machinery of the flat bed knitting machine 19 is connected to the input/output interface 13. Inputs from the machinery of the flat bed knitting machine 19 include carriage position, its direction of travel, and racking position of needle beds. Outputs to the machinery of the flat bed knitting machine include color yarns, needle selection, cam motors, carriage driving motors, oil feeding device 23, etc.

In the ROM 7 are stored programs 73, 74 for setting various data such as knitting machine gauge and kind of lubricant oil, an oil feeding data processing program 71 for oil feeding processing, and a knitting machine control program 72 for controlling the entire knitting machine. In the RAM 9 are stored various data corresponding to the above-mentioned programs, such as knitting data 91, gauge data 92, lubricant oil data 93 and oil feeding data 94.

Figure 2:
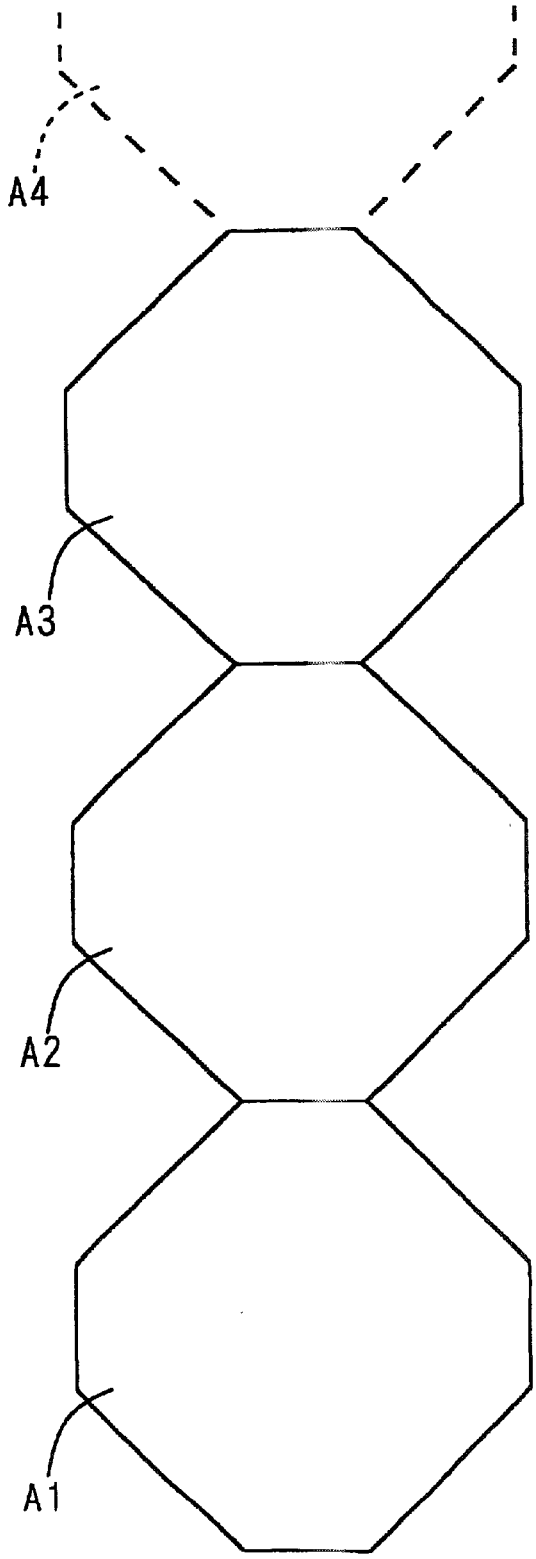
FIG. 2 shows knitting of a specified number of knitted fabrics.
Figure 3:
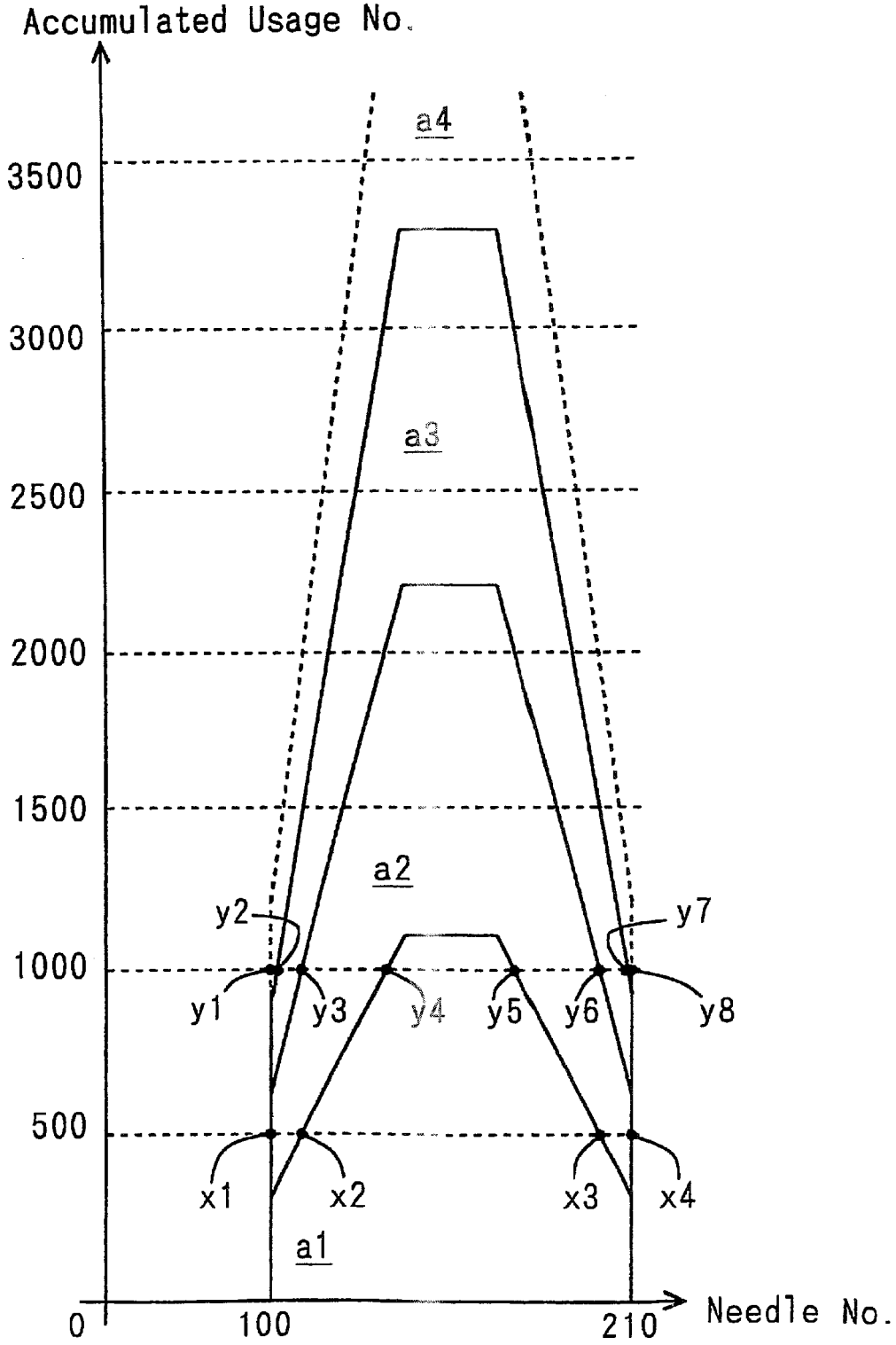
FIG. 3 is a graph showing the number of operations of each knitting needle while a specified number of knitted fabrics are knitted.

FIG. 2 shows that knitting of a knitted fabric A is repeated to knit a required number of knitted fabrics A. FIG. 3 is a graph showing the number of operations of each knitting needle when a plurality of knitted fabrics A are knitted. The number of operations is taken on the vertical axis and the needle number on the horizontal axis. The first knitted fabric through the 4th knitted fabric are indicated by A1 through A4, and the numbers of uses of knitting needles for the respective knitted fabrics are indicated by a1 through a4. A predetermined value of the number of operations of a needle for oil feeding is set, for example, at 500 times, and when the number of operations exceeds this value, oil feeding will be made. While the first knitted fabric A1 is knitted, each needle located between y4 and y5 is used more than 1000 times. As a result, oil feeding is made twice for them in the specified courses. Oil feeding is made once for needles between x2 and x3 except the above-mentioned needles between y4 and y5. No oil feeding is made for needles between x1 and x2 and between x3 and x4 during knitting of the first knitted fabric, and the first oil feeding is made for them during knitting of the second knitted fabric A2. The second oil feeding is made for the needles between y2 and y3 and needles between y6 and y7 during knitting of the third knitted fabric A3. The second oil feeding is made for the needles between y1 and y2 and needles between y7 and y8 during knitting of the fourth knitted fabric A4.

The lubricant oil data 93 is the data on knitting members to be fed with oil, such as needles, jacks, sinkers, etc. and kinds of lubricant oil that are used for these knitting members. The knitting members and kinds of lubricant oil can be set individually by using the lubricant oil setting program 74. On the basis of these combinations and parameters such as a gauge, speed of the knitting machine, etc., predetermined values for oil feeding are calculated by the oil feeding data processing program 71 or set manually as one thinks fit.

In the oil feeding data 94 are stored the number of operations of each knitting needle that is determined by the oil feeding data processing program 71 and the data on time when oil feeding is needed as the number of operations exceeds a predetermined value for oil feeding. The time data designates, for example, the course number of a specific knitted fabric An to be knitted in the nth order. As for the accuracy of the data, it is sufficient that oil feeding can be made at an appropriate timing according to the data. As described above, on the basis of the knitting data, the number of operations of each knitting needle per one knitted fabric is determined, and these numbers are added up for the required number of knitted fabrics to be produced to obtain cumulative data. Then oil feeding is made at an appropriate time to each knitting needle to be fed during the required number of knitted fabrics are knitted.

Next, with reference to the flow chart of FIG. 4, the process of generating the oil feeding points of the respective knitting needles by the above-mentioned oil feeding device will be described. First, in step 1 the process starts, and in step 2 the knitting data 91 that is developed by CAD is read from the external memory 17 of the control device 1. In step 3 the knitting data 91, which was read, is analyzed to count the number of operations of each knitting needle and determine the oil feeding points for knitting needles requiring oil feeding during one knitted fabric is knitted. Next, in step 4 it is checked whether the processing of the required number of knitted fabrics is completed. If it is not completed yet, in step 5 oil feeding points for knitting needles that are required in knitting the next knitted fabric are calculated. In this way, when the processing of the required number of knitted fabrics is completed, the processing is terminated (step 6).

Figure 4:
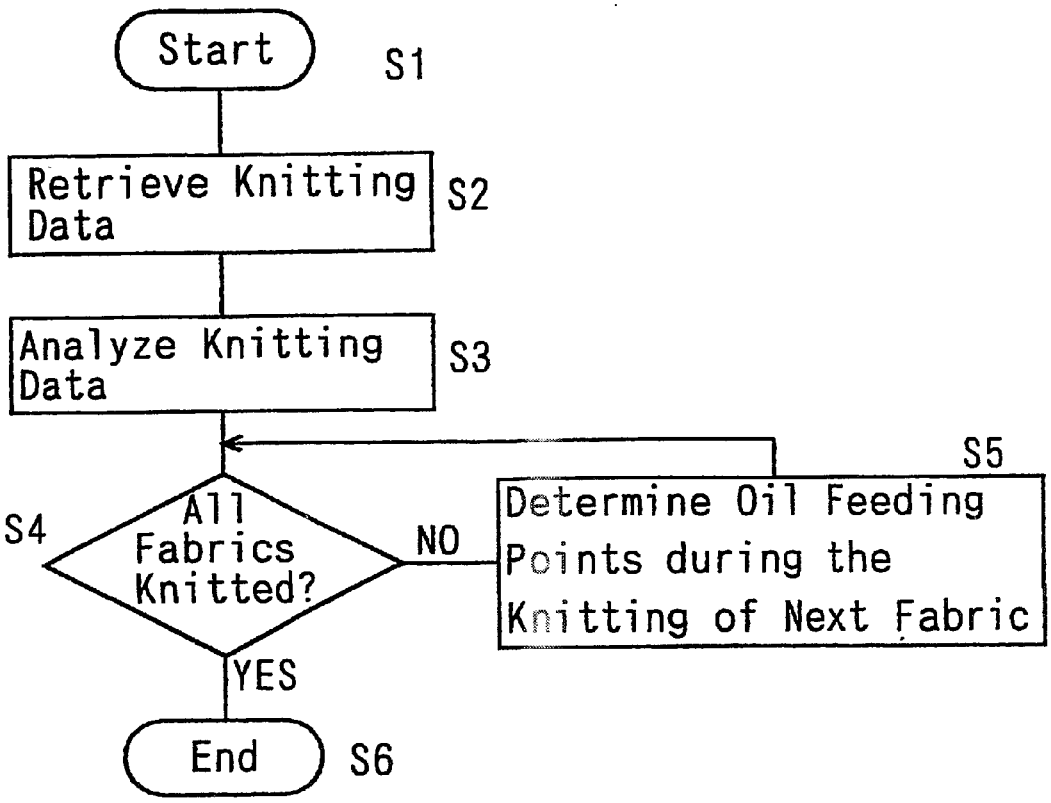
FIG. 4 is a flow chart of oil feeding data processing in the embodiment.
Figure 5:
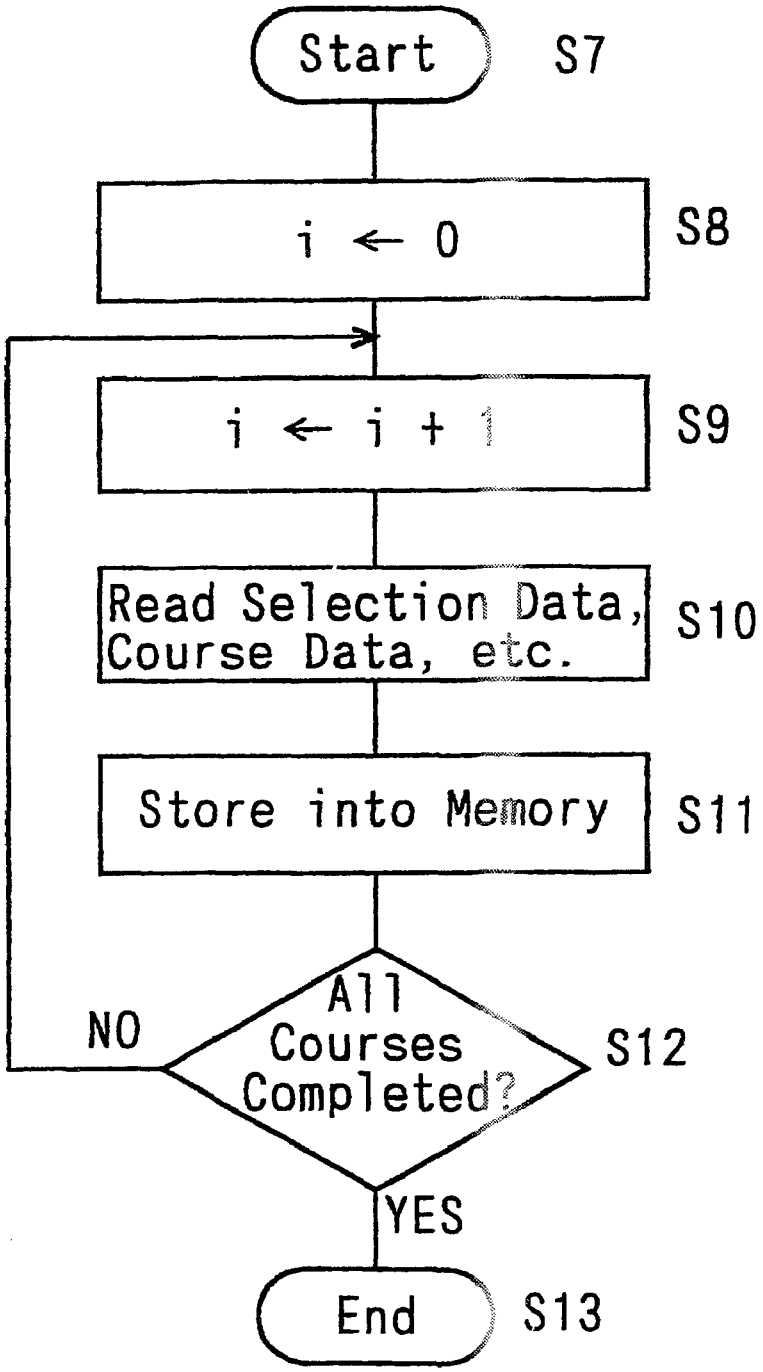
FIG. 5 is a flow chart of the knitting data analysis subroutine of the step 3 of FIG. 4.

FIG. 5 is a flow chart that describes in detail the analysis of the knitting data in step 3 of FIG. 4. The respective control courses (variable: i) of the knitting data are processed one after another from the first course down to the final course, and the numbers of uses of each knitting needle are added up and stored in memory. In this way, on the basis of the knitting data, oil feeding data of the respective knitting needles to be fed is processed, and while the actual knitting is taking place, the oil feeding device 23 is driven to make oil feeding at appropriate time.

In the above-mentioned embodiment, when the number of operations of each knitting needle used for knitting exceeds a predetermined value, oil will be fed to the knitting needle. In place of this arrangement, for example, the knitting needles of the needle beds may be grouped into blocks, each block having a specified number of knitting needles, and oil feeding may be made to a plurality of knitting needles of a block when, for example, the largest number of operations of a needle for knitting in the block exceeds a predetermined value. FIG. 6 shows an example of a stored oil feeding data that is displayed on the screen, the touch panel when oil feeding is made by block. It shows each block of needles is fed with oil in which course of the nth knitted fabric.

EMBODIMENT 2

In this embodiment, oil feeders comprise contact members such as brushes or felt, and the contact members are driven by driving means such as electromagnetic actuators to advance, when oil feeding is needed, to a position wherein brushes or the like contact knitting needles or at least drops of lubricant oil come into contact with knitting needles, and to withdraw otherwise.

In the case of this embodiment, just like the above-mentioned embodiment, brushes may be driven according to the number of operations of each knitting needle. It, however, is preferable that ON/OFF of the brushes is switched course by course, or the knitting needles of the needle beds are grouped into blocks having a specified number of needles and ON/OFF of the brushes is switched block by block . In this way, even if the responsiveness of the brushes in advancing and withdrawing is not very fast, oil feeding can be made to knitting members at the required points on the needle beds. For example, when two-fabric knitting is made, a zone of needles that are present between the knitted fabrics and are not used for knitting can be manually inputted as a block not to be fed, or the above-mentioned zone of needles may be determined from the knitting data and specified as a block not to be fed, and when the carriage passes over this zone, the actuators are turned off to withdraw the brushes. With this arrangement, knitting members within the knitting width are fed with oil, for example, every specified number of courses, and wasteful oil feeding can be prevented.

EMBODIMENT 3

The oil feeding device of this embodiment is provided with feeders that can make very fine control of discharge of lubricant oil, and like the driving of the actuators of the needle selector, with the travel of the carriage, oil is fed to butts of needles to be used in knitting while necessary needles are selected according to the knitting data. The quantity of oil to be fed is just the quantity needed for a single use.

Machinery

Figure 7:
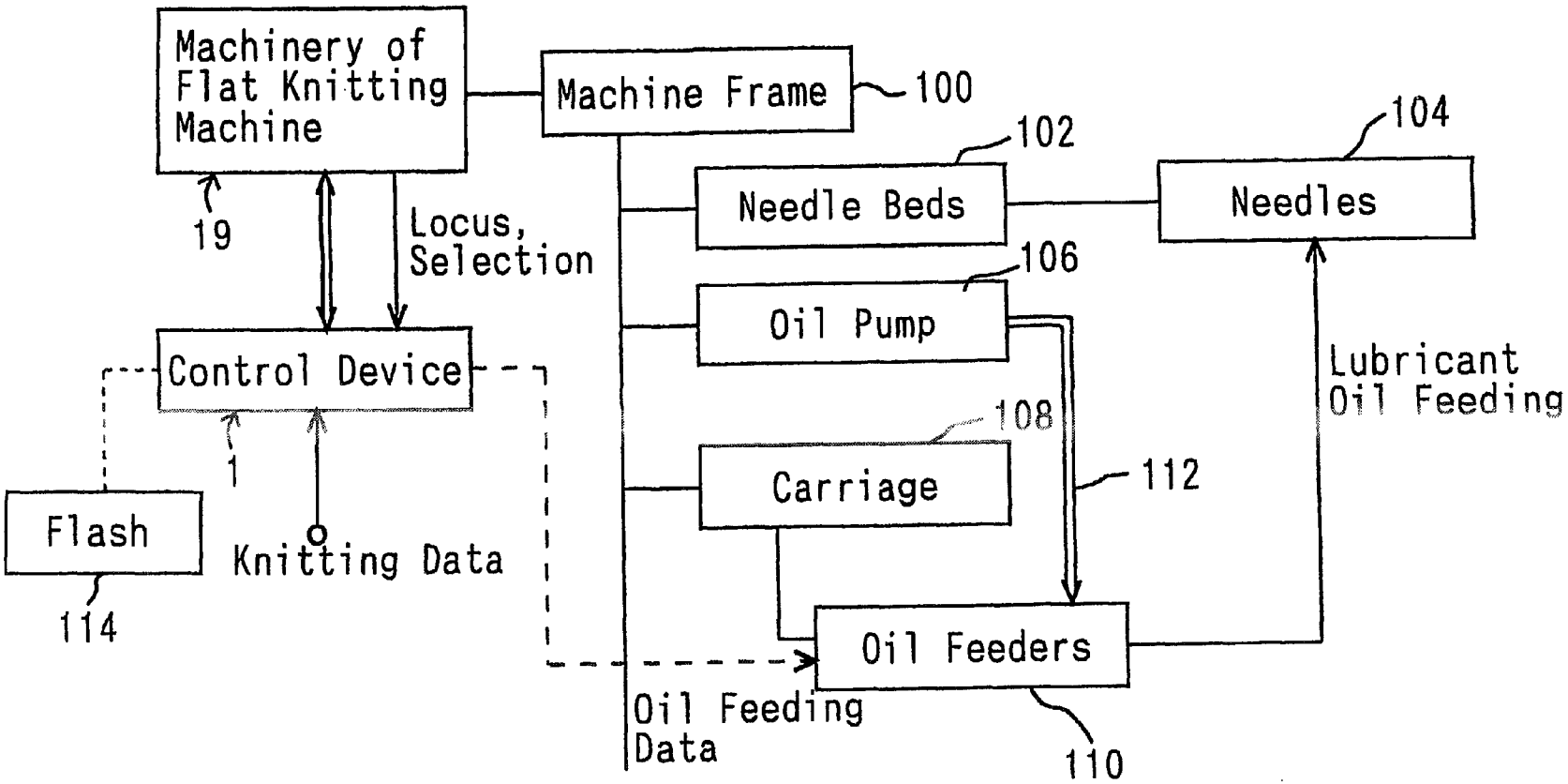
FIG. 7 is a block diagram mainly showing the oil feeding device and the machinery of the embodiment.
Figure 8:
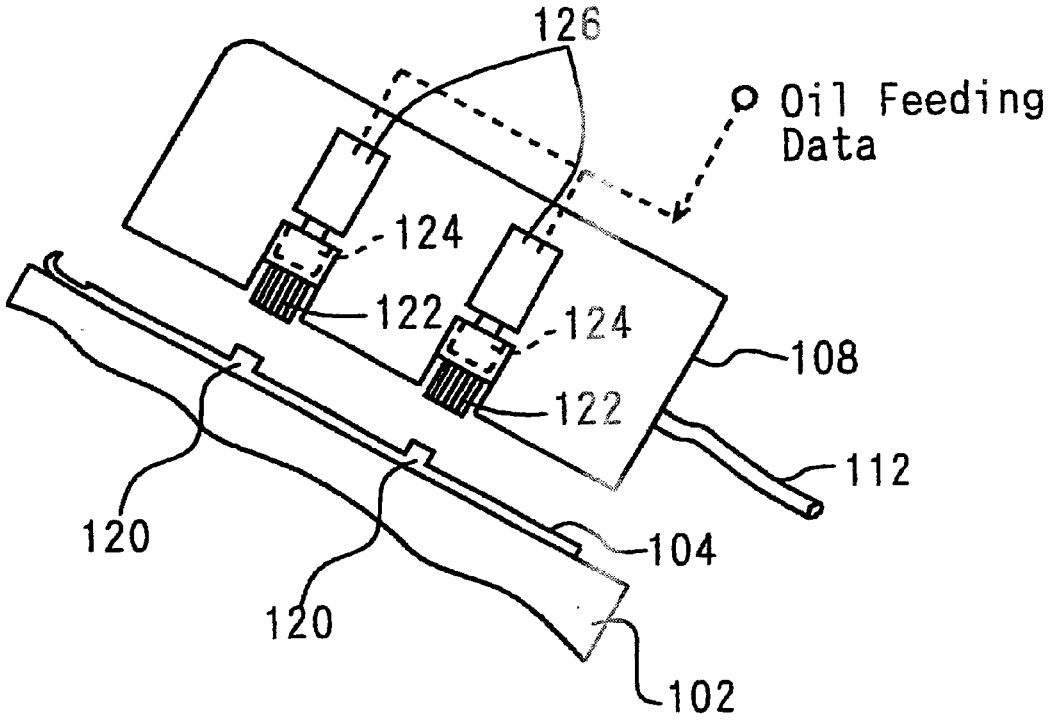
FIG. 8 schematically shows an oil feeder using brushes.
Figure 9:
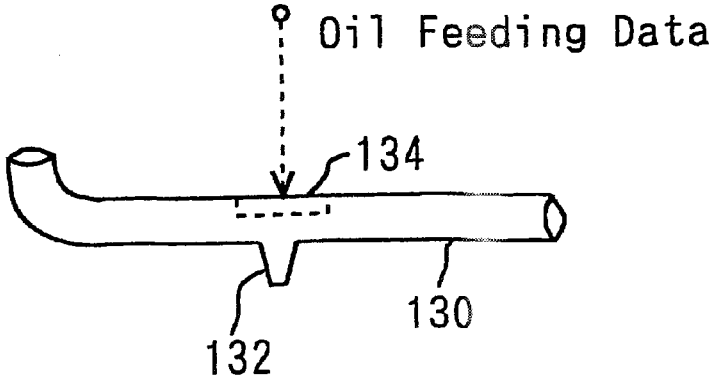
FIG. 9 schematically shows a jet-type nozzle.

FIG. 7 through FIG. 9 show mainly the machinery of the above-mentioned embodiments. In these diagrams, 19 is the machinery of the flat bed knitting machine, and the machine frame 100 carries at least a pair of needle beds 102, and a large number of knitting members such as needles 104 are arranged in parallel with each other on the needle beds. The machine frame 100 is provided with an oil pump 106, from which lubricant oil is conveyed through interconnection pipes 112 to oil feeders 110 mounted on the carriage 108 above respective needle beds. The control device 1 controls the oil feeders 110, and when the number of operations is to be determined from the locus of the carriage 108 or selection and operation of needle, the control device 1 receives from the machinery of the flat bed knitting machine 19 information concerning the carriage position and selection and operation of needle. Generally speaking, when the carriage selects a knitting member, the carriage will operate said knitting member.

114 is a flash memory and prevents loss of the data on accumulated numbers of operations of the knitting members when the power of the control device 1 is turned off. Any knitting member, which is not used up to the predetermined number of operations in one day, will be fed with oil when its accumulated number of operations reach the predetermined number of operations after use in plural days. In stead of this, it may be arranged that the control device 1 generates oil feeding data when power is turned on, normally at the beginning of the day's work, such that oil is fed to all knitting members.

As shown in FIG. 8, the brush 122, being an example of the oil feeder, is provided for every butt 120 of the knitting members and stored in the carriage 108. The brush 122 stores lubricant oil from the interconnection pipe in, for example, felt 124, and the brush 122 is moved by actuators 126, solenoids in this case, between a position wherein the brush 122 contacts the butt 120 and a position wherein the brush 122 is withdrawn. When oil feeding is made block by block, the condition of oil feeding is that the maximum number of operations of any needle within a block reaches a predetermined value. The block may be a fixed block, and the knitting width may be grouped into a single block or plural blocks.

A jet-type nozzle 132 is shown in FIG. 9. The nozzle 132 is provided on a recirculation pipe 130. Lubricant oil near the nozzle 132 is constantly preheated by a micro-heater 134, and the micro-heater 134 is controlled according to the knitting data. One end of the recirculation pipe 130 is connected to an oil pump, and to prevent clogging of lubricant oil of high viscosity, lubricant oil inside the pipe is constantly made to move. The other end of the pipe is connected to an oil sump of the oil pump. The viscosity of lubricant oil near the nozzle 132 is lowered before jetting, namely, before spraying, by preheating with the micro-heater 134. When the oil heating data demands spraying lubricant oil to a specific knitting member, the power of the micro-heater 134 will be increased to rapidly blister lubricant oil and spray it from the nozzle 132.

Remarks

In the above-mentioned respective embodiments, the control device reads the knitting data of a knitted fabric and makes data analysis to determine oil feeding points of knitting needles that are needed for knitting. In place of such processes, oil feeding points of the knitting needles may be obtained by using an analytical program that is installed on a CAD when the knitting data is developed by using the CAD. With this arrangement, the knitting machine can start knitting the knitted fabric immediately after reading the knitting data.

There is a production method that is commonly called schedule knitting, wherein, for example, various parts constituting a knit wear are knitted separately in the order of the front body, the back body, the right sleeve and the left sleeve, and they are repeatedly knitted as a single unit. In this case, knitted fabrics for a suit correspond to a piece of knitted fabric. In this case, the knitting data for one time of schedule knitting is analyzed to determine oil feeding points of the respective knitting needles.

In place of reading the knitting data in advance, needles that are scanned or selected by the carriage may be detected and the numbers of uses of such needles may be counted during actual knitting, and the oil feeding points may be determined when this value exceeds a predetermined value. In this case, analysis of the knitting data before knitting is not required, and even if the design of a fabric to be knitted is modified, the counted values prior to the modification can be taken over. During the first knitting of a knitted fabric, the locus of the carriage in the actual knitting may be monitored, in particular, needle selection may be monitored to determine oil feeding points for knitting the second and subsequent fabrics. The locus of the carriage may be determined by analyzing the knitting data.

In the above-mentioned respective embodiments, if oil is fed when a predetermined value is exceeded or being exceeded, this does not mean in the strict sense of the word, for example, if the predetermined value is set at 500 times, oil is fed at the 500th time, the 1000th time, . . . For example, if there is a knitting needle of which number of operations reaches 500 times in the present course, the number of a course that will use this knitting needle is determined. If said course is to be executed after a considerable time, the timing of oil feeding may be delayed to the next course. If data processing is done in this way, such troubles that lubricant oil drips down from knitting needles being fed with oil can be prevented.

It is a common practice that a plurality of varied knitting members such as selectors, select jacks, jacks, needles and sinkers are stored on the needle beds and cams of the carriage engage with operating butts of the respective knitting members to operate them. In such a case, it is desirable to feed oil by separately setting predetermined values of the number of operations according to the kind of lubricant oil to be used and the material, etc. of the knitting members.

What is claimed is:

1. A flat bed knitting machine having an oil feeding device comprising at least a pair of a front needle bed and a rear needle bed, wherein a plurality of knitting members such as needles and jacks are positioned parallel to each other on the needle beds such that they move forwards and backwards, and a carriage moving and scanning reciprocally on the needle beds and having cams for selecting and operating knitting members according to knitting data for knitting a knitted fabric being characterized by:

an oil feeding device including a lubricant oil supplying means for supplying lubricant oil through interconnection pipes to oil feeders being provided to the carriage for feeding lubricant oil to said plurality of knitting members;

oil feeding data processing means for determining and outputting knitting members to be fed with lubricant oil as oil feeding data according to the knitting data or a locus of the carriage; and control means for controlling the oil feeding device according to the oil feeding data during knitting of the knitted fabric such that said knitting members to be fed are fed with lubricant oil.

2. A flat bed knitting machine having an oil feeding device according to claim 1 being characterized in that said control means controls the oil feeders.

3. A flat bed knitting machine having an oil feeding device according to claim 2 being characterized in that said oil feeding data processing means determines said knitting members to be fed by evaluating numbers of operations of knitting members according to the knitting data.

4. A flat bed knitting machine having an oil feeding device according to claim 3 being characterized in that said oil feeding data processing means determines said numbers before knitting of a knitted fabric according to a knitting data of said knitted fabric.

5. A flat bed knitting machine having an oil feeding device according to claim 2 being characterized in that said oil feeding data processing means determines the locus of the carriage during knitting of a fabric and determines knitting members to be fed from the determined locus of the carriage.

6. A flat bed knitting machine having an oil feeding device according to claim 5 being characterized in that said oil feeding data processing means determines said knitting members to be fed by counting numbers of operations of knitting members by the carriage.

7. A flat bed knitting machine having an oil feeding device according to claim 2 being characterized in that said plurality of knitting members are grouped into plural blocks, that said oil feeding data processing means determines said knitting members to be fed block by block, and that said oil feeders feed lubricant oil to knitting members block by block.

8. A flat bed knitting machine having an oil feeding device according to claim 7 being characterized in that said oil feeder is provided with a contact member supplying lubricant oil to knitting members in contact with them and an actuator for moving the contact member between a position in contact with knitting members and a position not in contact with knitting members.

9. A flat bed knitting machine having an oil feeding device according to claim 2 being characterized in that said oil feeding data processing means determines said knitting members to be fed by counting numbers of operations of respective knitting members by the carriage and by comparing the numbers counted with a predetermined threshold value.

10. A flat bed knitting machine having an oil feeding device according to claim 9 being characterized in that said oil feeder is provided with a jet-type nozzle for spraying lubricant oil.

11. A flat bed knitting machine having an oil feeding device according to claim 10 being characterized in that said jet-type nozzle sprays lubricant oil selectively to respective knitting members to be fed while the carriage moves on the needle beds.

12. A flat bed knitting machine having an oil feeding device according to claim 11 being characterized in that said jet-type nozzle sprays lubricant oil to respective knitting members to be fed in a synchronous manner that the carriage selects said respective knitting members.

13. A flat bed knitting machine having an oil feeding device according to claim 3 being characterized in that said oil feeding data processing means accumulates the number of operations of knitting members for a plurality of the knitted fabrics to be knitted according to the knitting data and determines knitting members to be fed.

14. A flat bed knitting machine having an oil feeding device according to claim 5 being characterized in that said oil feeding data processing means accumulates the number of operations of knitting members for a plurality of the knitted fabrics to be knitted according to the locus of the carriage.

* * * * *